US011512491B2

(12) United States Patent
West

(10) Patent No.: US 11,512,491 B2
(45) Date of Patent: Nov. 29, 2022

(54) HOLLOW POST ANCHORING SYSTEMS FOR DECKING AND RELATED METHODS

(71) Applicant: Alpine Marketing International, Inc., Sandy, UT (US)

(72) Inventor: Ron West, Sandy, UT (US)

( * ) Notice: Subject to any disclaimer, the term of this patent is extended or adjusted under 35 U.S.C. 154(b) by 384 days.

(21) Appl. No.: 16/192,635

(22) Filed: Nov. 15, 2018

(65) Prior Publication Data

US 2019/0203493 A1 Jul. 4, 2019

Related U.S. Application Data

(60) Provisional application No. 62/612,148, filed on Dec. 29, 2017.

(51) Int. Cl.

| | |
|---|---|
| ***E04F 11/18*** | (2006.01) |
| ***E04H 12/22*** | (2006.01) |
| ***E04B 1/41*** | (2006.01) |
| *E04B 1/38* | (2006.01) |
| *E04B 1/24* | (2006.01) |
| *E04B 1/00* | (2006.01) |

(52) U.S. Cl.

CPC ..... *E04H 12/2253* (2013.01); *E04B 1/40* (2013.01); *E04F 11/1812* (2013.01); *E04F 11/1817* (2013.01); *E04H 12/2276* (2013.01); *E04B 1/003* (2013.01); *E04B 2001/2463* (2013.01); *E04B 2001/405* (2013.01)

(58) Field of Classification Search

CPC .. F16B 2200/40; F16B 2200/406; F16B 7/18; E04F 11/1817; E04F 11/1812

USPC ..... 256/65.09, 65.08, 65.14; 248/218.4, 248/227.3; 52/745.17, 741.14, 741.15, 52/698, 701, 704, 705, 295, 296, 298, 52/165, 169.13

See application file for complete search history.

(56) References Cited

U.S. PATENT DOCUMENTS

| | | | | |
|---|---|---|---|---|
| 3,233,871 A * | 2/1966 | Schroer | ..... | E04F 11/1817 256/69 |
| 3,471,182 A * | 10/1969 | Schroer | ..... | F16B 7/22 403/231 |
| RE36,550 E | 2/2000 | West | | |

* cited by examiner

*Primary Examiner* — Sunil Singh

(74) *Attorney, Agent, or Firm* — Wright Law Group, PLLC; Mark F. Wright

(57) ABSTRACT

Apparatus, systems, and methods for securing anchoring posts to a decking surface without the use of a metal plate or washer to redirect force from a single central fastener on an internally mounted anchor, or the use of an externally visible connector. An anchor member having a generally planar upper surface and vertical sidewalls has connection ridges extending out from those sidewalls that correspond to channels formed in the internal sidewalls of a hollow post member. Using a press, the anchor member is pressed into a secured position in the post. A plurality of attachment holes are disposed in a pattern around the anchor member, passing through the body thereof. For installation, a post with the fitted anchor is placed on a decking surface and a plurality of screws are attached to the decking surface to secure the anchor member and post thereto.

34 Claims, 5 Drawing Sheets

HOLLOW POST ANCHORING SYSTEMS FOR DECKING AND RELATED METHODS

CROSS-REFERENCE TO RELATED APPLICATION

This application claims the benefit of U.S. Provisional Application No. 62/612,148 filed Dec. 29, 2017, entitled "HOLLOW POST ANCHORING SYSTEMS FOR DECKING AND RELATED METHODS," which is hereby incorporated by referenced herein in its entirety, including but not limited to those portions that specifically appear hereinafter, the incorporation by reference being made with the following exception: In the event that any portion of the above-referenced application is inconsistent with this application, this application supersedes said above-referenced application.

TECHNICAL FIELD

The present disclosure relates to systems and methods for attaching hollow posts, such as vinyl posts for railings, to decking.

BACKGROUND

There are a number of known systems for securing posts that support a fence or a railing. For example, U.S. Pat. No. 8,117,798, the disclosure of which is incorporated by reference herein, discloses an apparatus with a base that can be attached to a surface and a tubular member that extends upward from the base, which is used to pierce a solid post. U.S. Pat. RE 36550, a reissue of U.S. Pat. No. 5,404,682, the contents of each of which are incorporated by reference herein in their entireties, discloses an adjustable mounting for a hollow post that uses a ball segment and seat to provide adjustability to a hollow post when attached to an unleveled anchor.

Turning to FIG. 1, a mounting system currently used and sold by the applicant is depicted. An anchor member 100 is formed as a body having an external lip that is held in a channel formed in the sidewall of a hollow post P. A bolt 104 that is secured to an anchor 108 in concrete 110 passes through a central hole in the anchor member 100. A large metal plate or washer 102 is disposed on the anchor member 100 and a nut 106 is used on the bolt 104 to secure the anchor 100 thereon. It has been found that the washer 102 is necessary to prevent the nut 104 from damaging the anchor due to the force required to properly secure the post. Otherwise the anchor may be caused to "cave in" or otherwise fail. In addition to a concrete anchor 108, this system has been used with bolts set directly in concrete or lag bolts that pass through decking material.

FIG. 2, depicts a fixture 20, that is used to allow the anchor of FIG. 1 attach to a decking surface. A flat metal base 200 includes several screw holes 202 that allow attachment to decking or another flat surface. A threaded rod 204 is welded to a middle portion of the base 200 and rises directly therefrom. As depicted, the large metal washer 102 is sized and configured to be retained on the rod 204 when a post P is attached thereon as depicted in FIG. 1. While the system of FIG. 1 when used with the fixture of FIG. 2, has been successful in operation, it requires additional steps to install leading to increased labor costs, and the use of the custom fixture 200, which can increase materials cost per post. A system or method that allowed for a hidden and secure attachment of posts to a decking surface without these additional expenses would be an improvement in the art. Such a method or system that could be used for multiple different attachment methods would be a further improvement in the art.

SUMMARY

The present disclosure includes apparatus, systems, and methods for securing anchoring posts to a decking surface without the use of a metal plate or washer to redirect force from a single central fastener on an internally mounted anchor, or the use of an externally visible connector. An anchor member having a generally planar lower surface and vertical sidewalls has connection ridges extending out from those sidewalls that correspond to channels formed in the internal sidewalls of a hollow post member. A taper is formed at the bottom end of the post to allow the anchor member to slip past the end of the post, which would normally be a blunt end preventing the anchor member from being inserted. Using a press, the anchor member is pressed past the taper and into a secured position in the post. A plurality of attachment holes are disposed in a pattern around the anchor member, passing from the planar lower surface through the body thereof. For installation, a post with the fitted anchor is placed in the desired position on a decking surface and a plurality of lag screws or other fastening devices are attached to the decking surface to secure the anchor member and post thereto. The use of multiple screws at multiple locations on the anchor member reduces the force at any single location, reducing the chance for installation failure while achieving secure attachment of the post.

DESCRIPTION OF THE DRAWINGS

It will be appreciated by those of ordinary skill in the art that the various drawings are for illustrative purposes only. The nature of the present disclosure, as well as other embodiments of the present invention, may be more clearly understood by reference to the following detailed description, to the appended claims, and to the several drawings.

DETAILED DESCRIPTION

Figure 5A:
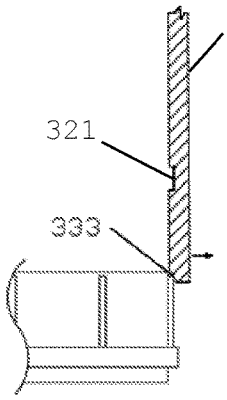
FIGS. 5, 5A, and 5B are sectional views of a hollow post displaying side views of the anchor member of FIGS. 3A, 3B, and 3C used to attach the post to a decking surface.
Figure 5B:
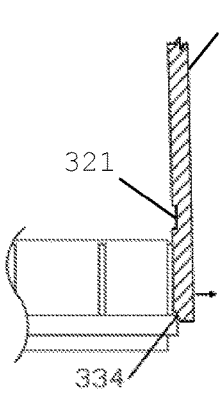
Figure 5:
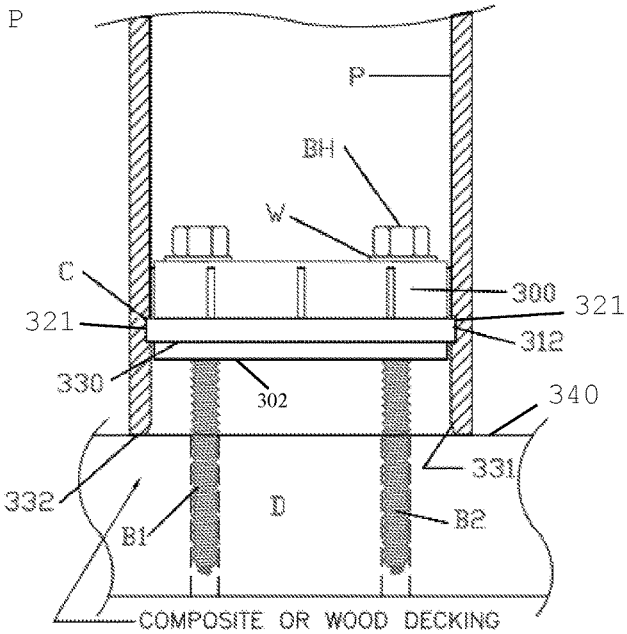

The present disclosure relates to systems and methods for securing hollow posts, such as posts P shown in FIG. 5, for a railing attached to a decking surface 340, such as a deck made of wood or a composite material or on a set of stairs. It will be appreciated by those skilled in the art that the embodiments herein described, while illustrating certain embodiments, are not intended to so limit the disclosure or the scope of the invention. Those skilled in the art will also understand that various combinations or modifications of the embodiments presented herein can be made without departing from the scope of this disclosure. All such alternate embodiments are within the scope of the present invention.

Referring to FIGS. 3A, 3B, 3C, and 5, a first embodiment of an anchor member 30 is depicted. As depicted, anchor member 30 may be formed as a body 300 having a generally planar lower surface 302 with a surrounding sidewall 310. In the depicted embodiment, the sidewall 310 may include a lower ridge that extends past the upper surface. At an upper surface, the body 300 may be open with a series of reinforcing walls 330 surrounding voids 320 to reduce weight and material usage, although it will be appreciated that solid embodiments may be contemplated.

In the depicted embodiment, the body 300 has an octagonal shape with four longer sides that generally define a square with respect to one another, and four smaller sides that "cut off" the corners of the square. These smaller sides may also be radiused. The depicted embodiment is intended for use with a generally square hollow post, but it will be appreciated that other shapes may be used, for example, with non-square rectangular posts, ovoid posts, or rounded posts. The shape of the body may be varied to accommodate such posts.

Along each of the four longer sides, a ridge 312 extends laterally from the sidewall 310. As depicted, each ridge 312 may be formed as a shelf having a thickness with generally planar upper and lower surfaces. Further, each ridge 312 may taper outwardly, or bow, in a generally horizontal direction, such that the ridge 312 is convex and has a farthest extending lateral point 317 at a region near the midpoint of the side of the ridge 312 on which said farthest extending lateral point 317 is located, with a gradual taper to a corner 313, where the ridge 312 then shares a common angle with the shorter side 319. The generally horizontal taper 317 is shown more clearly in FIG. 3D. In practice, this has been found to facilitate placement in hollow vinyl posts, such as hollow post P as shown in FIG. 5 as the sidewalls of the post P will flex outward as the anchor member 30 is pressed into place, with the stiffer corners of the post P resisting such flexing. Upon installation, the ridges 312 will reside in corresponding channels 321 in the internal sidewall of the post, as discussed further herein. It will be appreciated that alternate embodiments of hollow posts with square corners are possible and may be useful for some particular installations.

Along each sidewall 310, vertically disposed insertion ridges 315 may extend from the top surface of the ridge 312 to the upper end of the anchor 30. Each insertion ridge 315 may be formed as a columnar protrusion having a thickness that is smaller than that of the ridge 312. In other embodiments, it may be angled from a smaller thickness near the ridge 312 to a thinner portion near the upper end. Although depicted as having a partially elliptical cross-section, it will be appreciated that each insertion ridge 315 may be a rectangular or other shape. An alternate method would be to extend the wall to the same distance from the center of the anchor as the outermost point on the ridges are from the center of the anchor. These ridges 315 are formed to aid in the insertion of the anchor 30 by pre-spreading the wall of the post P to allow the broader ridge 312 to slip past the taper 331 formed at the bottom end of the post P. The ridges 315 are formed such that they operate to prespread the post P at the open end of the post P as shown in FIG. 5, such that the taper 331 allows the anchor 30—specifically, the ridge 312 on the anchor 30—to slip past the taper 331 and avoid bottoming out on a blunt end of the post P at the open end of the post P as shown.

Figure 1:
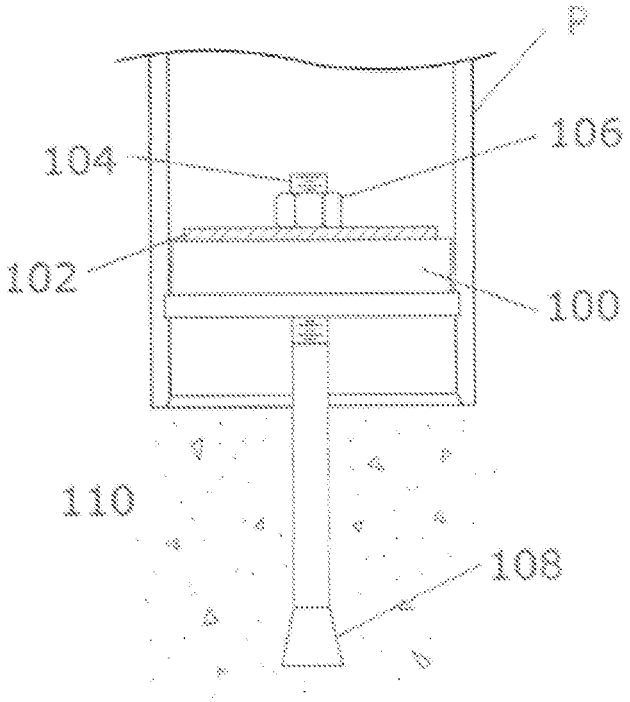
FIG. 1 Prior Art
FIG. 1 is a sectional side view of a prior art system currently used by applicant to attach hollow posts to a concrete or cement surface.
Figure 2:
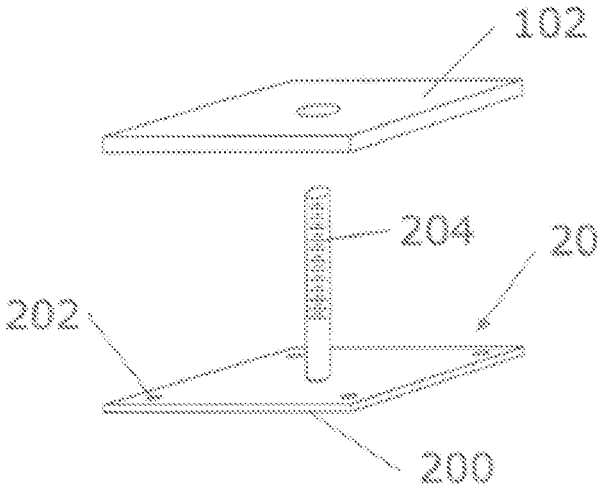
FIG. 2 Prior Art
FIG. 2 is a perspective view of a prior art fixture currently used by application to allow the system of FIG. 1 to be used on a decking surface.

A larger central attachment hole 304 is disposed in the center of the anchor member 30, passing from the lower surface 302 through the body 300. As depicted, the center hole may have a surrounding reinforcing wall and is sized for the insertion of a larger diameter bolt there through for a single point of fastening the post and anchor to a surface. This allows for use of the anchor member with the type of securing using a larger sized plate or washer as discussed above in connection with FIG. 1.

A number of smaller diameter decking attachment holes 306A, 306B, 306C, and 306D are disposed in the anchor member 30, spaced out from the center and from one another around the lower surface 302 and at points closer to the edges thereof. Each decking attachment hole passes from the lower surface 302 though the body 300. As depicted, each may have a surrounding reinforcing wall. Each decking attachment hole is sized for the insertion of a screw therethrough for attachment to decking as discussed further herein.

Figure 3A:
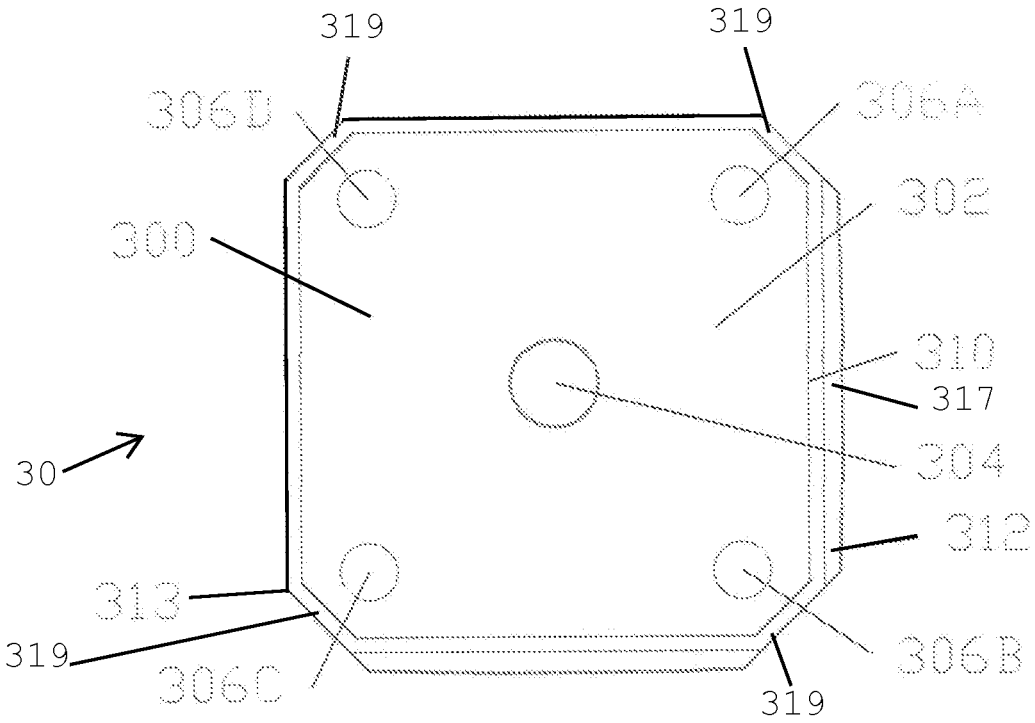
FIGS. 3A, 3B, and 3C are bottom, top, and side views, respectively of a first embodiment of an anchor member in accordance with the principles of the present disclosure.
Figure 3B:
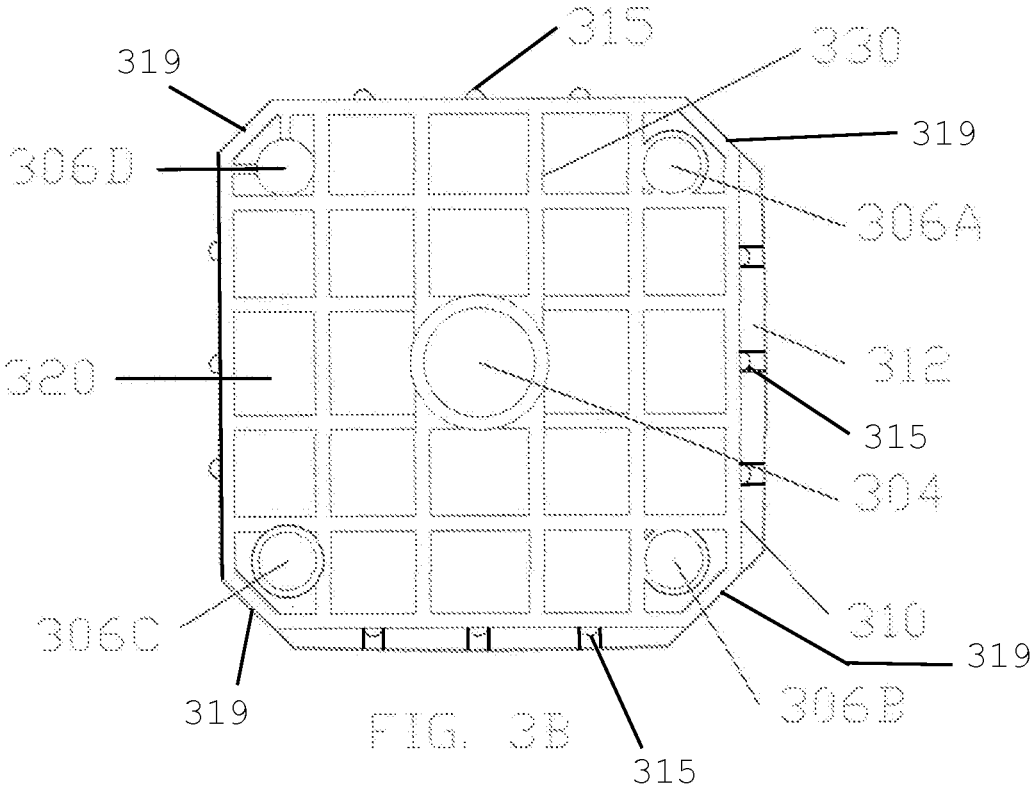
Figure 3C:
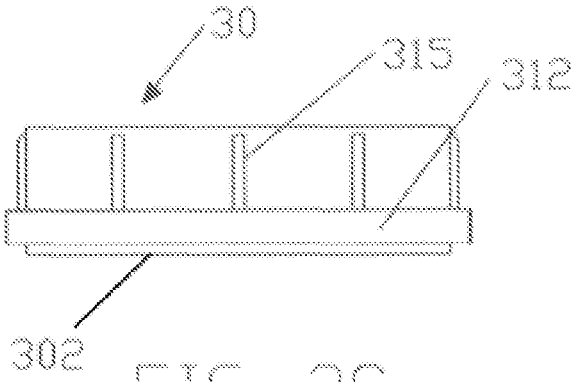
Figure 3D:
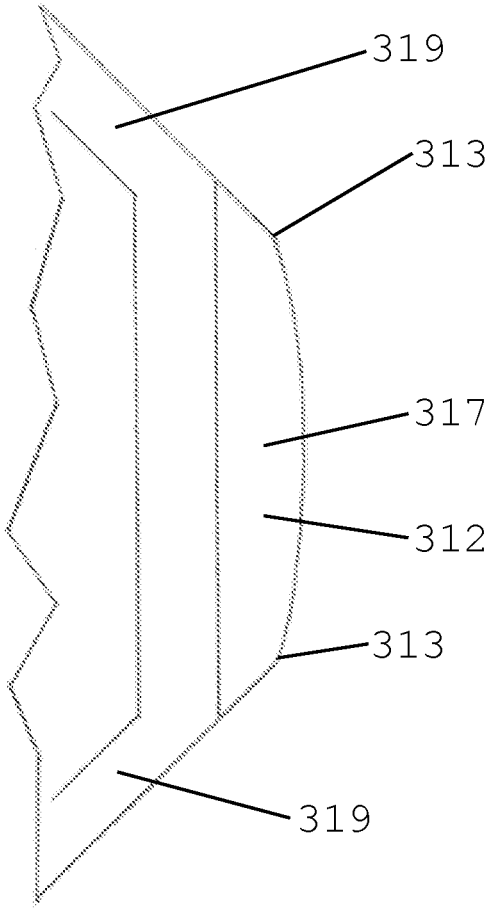
FIG. 3D is a breakaway view of the right side end section of FIG. 3A, in which a generally horizontal taper is shown schematically in a more exaggerated view.

In the embodiment depicted in FIGS. 3A and 3B, there are four decking attachment holes 306A, 306B, 306C, and 306D, each disposed at a location near a corner of the body 300 of the anchor member 30. It will be appreciated that the particular placement and number of decking attachment holes may vary. For example, anchor member 40A, depicted in FIG. 4A has four additional decking attachment holes 306E, 306F, 306G, and 306H each disposed through the body with an opening on the lower surface in line with a midpoint of each longer sidewall. FIG. 4B depicts anchor member 40B which includes four decking attachment holes 306I, 306J, 306K, and 306L each disposed through the body with an opening on the lower surface in line with a midpoint of each longer sidewall, but lacks the decking attachment holes disposed in the corners of the upper surface. These different numbers and locations can provide for additional flexibility, as by allowing for placement where additional securing screws are needed, or where the shape of a deck prevents placement of a screw near a corner of a post (as in a corner against a building) or where the decking 340 cannot accept a screw (due to placement over a joint between planks or fastener securing planking to a deck frame).

Referring now more particularly to FIGS. 5, 5A, and 5B, anchor member 30 is depicted in use with post P showing attachment to a deck D. Anchor member 30 is disposed in the internal bore of the hollow post P, which is typically constructed from a vinyl material, such as PVC, but not limited to such. The ridges 312 of the anchor member 30 are disposed in corresponding channels C in the internal sidewalls of post P, which are sized receive and retain the ridges therein.

A plurality of lag screws, depicted in FIG. 5 as B1 and B2 extend through the anchor 30 and into the material of the deck D to secure the post P in place. It will be appreciated that the head BH of a lag screw B2 may contact the upper surface of the anchor member and the shaft of the screws extend into the material of the deck with at least a portion of the threads securing in the material. Alternatively, and as depicted, a washer (such as a standard circular flat washer W) may be placed on the shaft of a lag screw B1 and contact the upper surface of the anchor. This may be especially useful where the upper surface is defined by reinforcing walls 330 and the voids there between.

It will be appreciated that the deck D needs to be constructed of a material that the screws B can be driven into to thereby secure the post in place. For example, wooden planks or composite decking material such as that commercially available under the trademarks TREX.

Figure 4A:
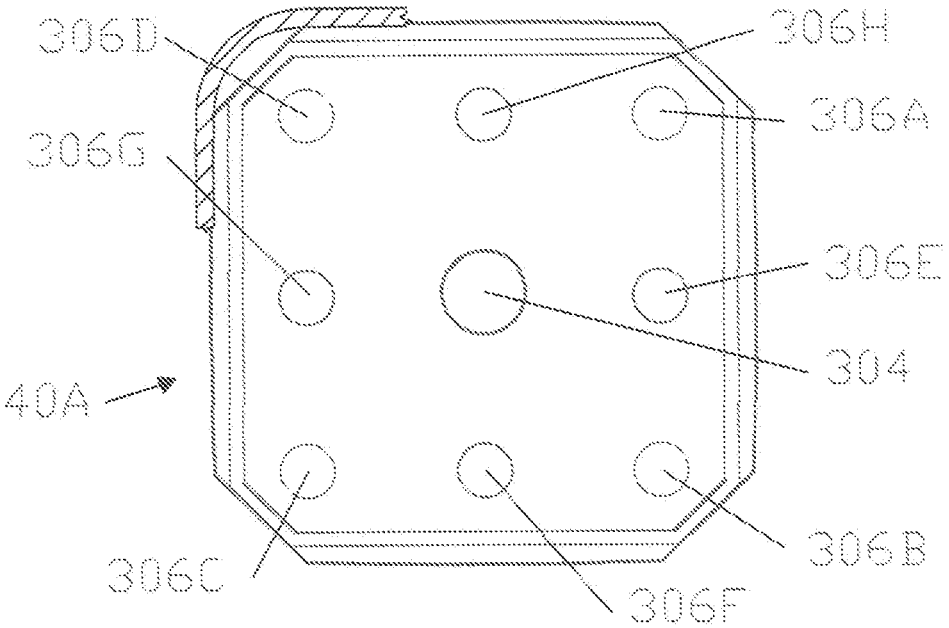
FIGS. 4A and 4B are bottom views of a two alternative embodiments of anchor members in accordance with the principles of the present disclosure.
Figure 4B:
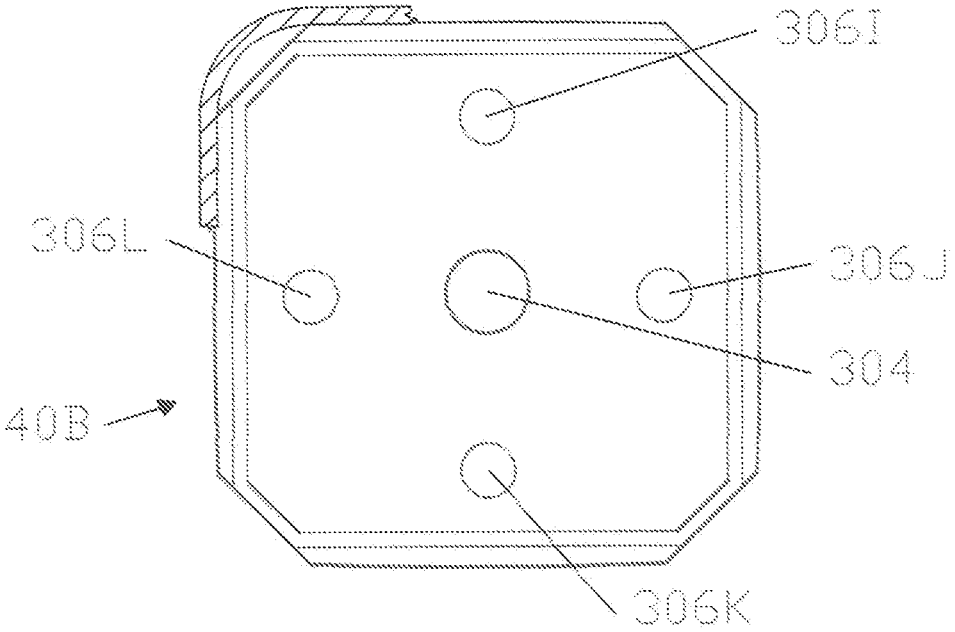

It will be appreciated that although only two lag screws B1 and B2 are depicted in the sectional view of FIG. 5, that in a typical installation four lag screws will be used, although embodiments using anchor members such as that depicted in FIG. 4A may use additional screws for increased securing. The anchoring method is not limited to lag screws and other types of fasteners may be used. The present disclosure further includes methods of installing posts to decking, and methods for building or installing deck and stair rails. Such methods include measuring and designing the railing for installation at a location with a surface faced with decking material, and determining the number, height, type and placement of posts for the railing.

Posts are then assembled based on the design, which may include cutting extruded tubing to the appropriate length for the various post, forming tapers 331 on the interior lower edges of a post P to facilitate insertion of an anchor, and cutting or forming appropriate grooves in the interior sidewalls of the post P to receive the ridges of the anchor member. Anchor members with a suitable number and placement of deck attachment holes 306 are then attached to the posts P by placement with a press. Each anchor member 30 may be inserted using a press that contacts the lower surface 302 and presses the anchor member 30 into the post P. As the anchor member 30 is inserted, the walls of the post P flex to allow ridge 312 to move down the bore of the post until aligns with the channel C. The vertically disposed ridges 315 serve as a guide for the flexion of the sidewall by acting as a fulcrum allowing the walls to expand a predetermined distance 333 thus allowing the broader ledge 312 to engage the taper formed at the end of the post 334 and to slip past the post's blunt end 332. The inset corners 313 provide for additional stress release on the post sidewalls to increase flexion. Once the anchor 30 is inserted a sufficient distance that the ridge 312 aligns with channel C, the sidewalls of the post P snap against the anchor sidewalls with the ridge 312 secured in the channel C. As depicted, anchor sidewall extending above and below the ridge 312 is contacted to provide a secure installation.

The posts P with the installed anchor members 30 are transported to the job site, and a post P is placed at the location for its installation. Alternatively, a post P could be used as a stand-alone post for signs or purposes other than railing. Where appropriate, pilot holes for the screws may be predrilled at the location installed. A plurality of lag screws are then placed through the screw attachment holes in the anchor member from the top of the post P, with one in each hole and driven into the deck D material. Where the lag screws have a polygonal head, a socket extension and ratchet or a large T-driver having a long shaft with a socket bottom that may include a magnet for retaining the screw head and a cross-bar handle may be used to drive each screw into the deck.

Each screw B is placed into the decking 340 and tightened against an upper surface of the anchor member 30. In prior art systems, the use of a thick square metal washer or plate to spread forces out across the surface of the anchor member was required to prevent damage at the center hole of the anchor. In the present methods, no such washer is required. However, to reduce the forces brought against any one point of the anchor member 30 during installation, an installer may install the screws and flat washers individually to retain the post P in place, but not fully tighten screws initially. Once all screws for a particular post P have been installed for that location, the installed screws are then tightened in an appropriate order to fully secure the post P in place. At this point the other components of the railing system can be attached to the post P in the appropriate manner.

While this disclosure has been described using certain embodiments, the present disclosure can be further modified while keeping within its spirit and scope. This application is therefore intended to cover any variations, uses, or adaptations of the disclosure using its general principles. Further, this application is intended to cover such departures from the present disclosure as come within known or customary practices in the art to which this invention pertains and which fall within the limits of the appended claims.

Additional Specification Support

Embodiment 1

An anchor for attaching a hollow post to a deck, including: a body with a generally planar lower surface and an upwardly extending sidewall; at least a first ridge extending laterally from the upwardly extending sidewall, the at least first ridge shaped and configured to be retained in a groove formed on an interior sidewall of a hollow post; and a plurality of holes, each passing from the lower surface of the body through a bottom of the body and sized to receive a lag screw, anchor or nut and bolt for attachment to a deck.

Embodiment 2

The anchor of embodiment 1, wherein the body has a generally polygonal shape.

Embodiment 3

The anchor of embodiment 2, wherein the body has a set of opposing longer sides corresponding to major sides of a hollow post and a set of shorter sides disposed between the opposing longer sides that correspond to corners of the hollow post.

Embodiment 4

The anchor of embodiment 2, wherein the at least first ridge is generally convex, with a furthest lateral extension corresponding to a midpoint of an opposing longer side.

Embodiment 5

The anchor of embodiment 1, further including at least a second ridge extending laterally from the upwardly extending sidewall at a point on the body opposite the at least a first ridge, the at least second ridge shaped and configured to be retained in a groove formed on an interior sidewall of a hollow post.

Embodiment 6

The anchor of embodiment 5, further including at least one vertical ridge disposed on the upwardly extending sidewall, the at least one vertical ridge extending from the top of the at least first ridge to an upper end of the body.

Embodiment 7

The anchor of embodiment 6, wherein the at least one vertical ridge has a generally columnar cross section.

Embodiment 8

The anchor of embodiment 6, wherein the at least one vertical ridge includes a set of parallel vertical ridges spaced along the upwardly extending sidewall along the at least first ridge.

Embodiment 9

The anchor of embodiment 6, further including at least a second vertical ridge disposed on the upwardly extending sidewall, the at least second vertical ridge extending from the top of the at least second ridge to an upper end of the body.

Embodiment 10

The anchor of embodiment 9, wherein the at least second vertical ridge includes a set of parallel vertical ridges spaced along the upwardly extending sidewall along the at least second ridge.

Embodiment 11

The anchor of embodiment 9, wherein the at least second vertical ridge tapers from a thicker lower portion to thinner upper end.

Embodiment 12

The anchor of embodiment 1, further including at least one vertical ridge disposed on the upwardly extending sidewall, the at least one vertical ridge extending from the top of the at least first ridge to an upper end of the body.

Embodiment 13

The anchor of embodiment 12, wherein the at least one vertical ridge includes a set of parallel vertical ridges spaced along the upwardly extending sidewall along the at least first ridge.

Embodiment 14

The anchor of embodiment 1, wherein the plurality of holes includes four holes spaced around a midpoint of the body.

Embodiment 15

An anchor for attaching a hollow post to a deck, including:

a body with a generally planar lower surface and an upwardly extending sidewall;

at least a first ridge extending laterally from the upwardly extending sidewall, the at least first ridge shaped and configured to be retained in a groove formed on an interior sidewall of a hollow post; and at least a first vertical ridge and an opposite second vertical ridge disposed on the upwardly extending sidewall on at least two opposing sides of mount, each of the at least first vertical ridge and second vertical ridge extending from the top of the at least first ridge to an upper end of the body.

Embodiment 16

The anchor of embodiment 15, wherein the body has a generally polygonal shape.

Embodiment 17

The anchor of embodiment 16, wherein the body has a set of opposing longer sides corresponding to major sides of a hollow post and a set of shorter sides disposed between the opposing longer sides that correspond to corners of the hollow post.

Embodiment 18

The anchor of embodiment 15, wherein the at least first ridge is generally convex, with a furthest lateral extension corresponding to a midpoint of an opposing longer side.

Embodiment 19

The anchor of embodiment 15, wherein the at least first vertical ridge has a generally columnar cross section.

Embodiment 20

The anchor of embodiment 15, wherein the at least first vertical ridge tapers from a thicker lower portion to thinner upper end.

Embodiment 21

The anchor of embodiment 15, wherein the at least first vertical ridge includes a set of parallel vertical ridges spaced along the upwardly extending sidewall along the at least first ridge.

Embodiment 22

The anchor of embodiment 21, wherein the at least second vertical ridge includes a set of parallel vertical ridges spaced along the upwardly extending sidewall along the at least second ridge.

Embodiment 23

The anchor of embodiment 15, further including a plurality of holes, each passing from the lower surface of the body through a bottom of the body and sized to receive a lag screw, anchor or nut and bolt for attachment to a deck.

Embodiment 24

The anchor of embodiment 22, wherein the plurality of holes includes four holes spaced around a midpoint of the body.

Embodiment 25

A deck post anchoring system, including:

a hollow deck post having an internal bore wherein at least a first lateral channel is disposed on a sidewall of the internal bore and a taper formed at the end of the post;

an anchor including a body with a generally planar upper surface and a downwardly extending sidewall, with at least a first ridge extending laterally from the downwardly extending sidewall, the at least a first ridge shaped and configured to be retained in the first lateral channel, a plurality of holes, each passing from the upper surface of the body through a bottom of the body and sized to receive a lag screw for attachment to a deck; and a plurality lag screws sized for placement in the plurality of holes.

Embodiment 26

The system of embodiment 25, wherein the hollow deck post has a taper formed at the end of the post as a lower edge that is beveled from an outer surface to internal bore.

Embodiment 27

The system of embodiment 25, wherein the hollow deck post and the anchor have corresponding generally polygonal shapes.

Embodiment 28

The system of embodiment 27, wherein the body anchor body has a set of opposing longer sides corresponding to major sides of the hollow deck post and a set of shorter sides disposed between the opposing longer sides that correspond to corners of the hollow deck post.

Embodiment 29

The system of embodiment 28, wherein the at least first ridge is generally convex, with a furthest lateral extension from the downwardly extending sidewall corresponding to a midpoint of an opposing longer side.

Embodiment 30

The system of embodiment 25, further including least a second lateral channel disposed on a sidewall of the internal bore of the hollow deck post and at least a second ridge extending laterally from the upwardly extending sidewall at a point on the anchor body opposite the at least a first ridge, the at least second ridge shaped and configured to be retained in the at least second lateral channel.

Embodiment 31

The system of embodiment 25, wherein the anchor further includes at least one vertical ridge disposed on the upwardly extending sidewall, the at least one vertical ridge extending from the top of the at least first ridge to an upper end of the body.

Embodiment 32

The system of embodiment 31, wherein the at least one vertical ridge has a generally columnar cross section.

Embodiment 33

The system of embodiment 31, wherein the at least one vertical ridge tapers from a thicker lower portion to thinner upper end.

Embodiment 34

The system of embodiment 31, wherein the at least one vertical ridge includes a set of parallel vertical ridges spaced along the upwardly extending sidewall along the at least first ridge.

Embodiment 35

The system of embodiment 34, wherein the set of parallel vertical ridges arranged to prespread the hollow deck post by interacting with the taper at the end of the post to thereby allow the anchor to slip past said open end of said post, to inhibit the anchor from bottoming out on said open end of said post during insertion.

Embodiment 36

The system of embodiment 25, wherein the plurality of holes includes eight holes spaced around a midpoint of the body.

Embodiment 37

The system of embodiment 36, wherein the plurality of lag screws includes four lag screws.

Embodiment 38

A method for installing posts to decking for a railing system, the method including:

determining the number, height, type and placement of posts for a railing to be installed at a location with a surface faced with decking material;

assembling the determined number of posts, by securing anchor members in a set of posts, each post having an internal bore with at least a first lateral channel formed in a sidewall of the hollow bore by inserting a separate anchor member into the hollow bore of each post of the set of posts, each anchor member including a body with an upper surface and a downwardly extending sidewall, with at least a first ridge extending laterally from the downwardly extending sidewall, the at least a first ridge shaped and configured to be retained in the first lateral channel, a plurality of holes, each passing from the upper surface of the body through a bottom of the body and sized to receive a lag screw for attachment to a deck, such that the at least first ridge passes through an end of the hollow post to reside in the at least first lateral channel;

placing each post with the inserted anchor member at its determined position over the surface faced with decking material for installation; and placing a plurality of lag screws through the plurality of holes and driving each lag screw into the surface faced with decking material.

Embodiment 39

The method of embodiment 38, wherein placing the plurality of lag screws through the plurality of holes and driving each lag screw into the surface faced with decking material includes contacting the head of a lag screw directly to the upper surface of the anchor member.

Embodiment 40 The method of embodiment 38, wherein placing the plurality of lag screws through the plurality of holes and driving each lag screw into the surface faced with decking material includes placing four lag screws through four holes of the plurality of holes and driving each of the four lag screws into the surface faced with decking material.

Embodiment 41

The method of embodiment 38, wherein securing anchor members in a set of posts, each post having an internal bore with at least a first lateral channel formed in a sidewall of the hollow bore by includes securing anchor members in a set of posts, each post having an open end with a taper formed at the open end as a lower edge that is beveled from an outer surface of the post to the internal bore.

Embodiment 42

The method of embodiment 41, further including forming the taper at the open end of each post by beveling a lower edge of a sidewall of the post from an outer surface of the post to the internal bore.

Embodiment 43

The method of embodiment 41, wherein inserting a separate anchor member into the hollow bore of each post of the set of posts includes inserting an anchor member including at least one vertical ridge disposed on the downwardly extending sidewall, the at least one vertical ridge extending from the top of the at least first ridge to an upper end of the anchor member.

Embodiment 44

The method of embodiment 43, wherein inserting an anchor member including at least one vertical ridge disposed on the downwardly extending sidewall includes inserting an anchor member including a set of parallel vertical ridges arranged to prespread the hollow deck post by interacting with the taper at the end of the post to thereby allow the anchor to slip past said open end of said post.

Embodiment 45

The method of embodiment 38, wherein inserting a separate anchor member into the hollow bore of each post of the set of posts includes inserting an anchor member having a set of opposing longer sides corresponding to major sides of the post and a set of shorter sides disposed between the opposing longer sides that correspond to corners of the post.

Embodiment 46

The method of embodiment 45, wherein inserting a separate anchor member into the hollow bore of each post of the set of posts includes inserting a separate anchor member where the at least first ridge is generally convex, with a furthest lateral extension from the downwardly extending sidewall corresponding to a midpoint of an opposing longer side.

Embodiment 47

The method of embodiment 46, wherein inserting a separate anchor member where the at least first ridge is generally convex, with a furthest lateral extension from the downwardly extending sidewall corresponding to a midpoint of an opposing longer side includes flexing the sidewall of the post over the at least first ridge until the at least first ridge aligns with the at least first lateral channel.

Embodiment 48

A method for installing an anchor in a post for a railing system, the method including:

providing an anchor having an insertion side and a trailing side, where the insertion side is wider than a widest space between walls of a hollow post and the insertion side is narrower than a widest portion of the anchor;

inserting the anchor, insertion side first, into a tapered open end of the hollow post to thereby cause the insertion side to spread walls of the hollow post into a first expanded position;

advancing the anchor further into the post until a widest portion of the anchor is received within the hollow post to thereby cause said widest portion of the anchor to spread the walls of the hollow post into a second expanded position such that said walls are further apart than they were when in the first expanded position; and advancing the anchor further into the post until the widest portion of the anchor is received into receiving grooves formed in interior sides of the walls of the hollow post, at which point the walls of the post contract and capture the anchor.

Embodiment 49

The method of embodiment 48, wherein providing an anchor having an insertion side and a trailing side, where the insertion side is wider than a widest space between walls of a hollow post and the insertion side is narrower than a widest portion of the anchor includes providing an anchor having a body with an upper surface and a downwardly extending sidewall corresponding in shape to the internal bore of the hollow post with at least a first laterally extending member disposed on the sidewall.

Embodiment 50

The method of embodiment 49, wherein providing an anchor having a body with an upper surface and a downwardly extending sidewall corresponding in shape to the internal bore of the hollow post with at least a first laterally extending member disposed on the sidewall includes providing an anchor having at least one vertical ridge disposed on the downwardly extending sidewall, the at least one vertical ridge extending from a top of the at least first laterally extending member to an upper end of the anchor member.

Embodiment 51

The method of embodiment 50, wherein inserting the anchor, insertion side first, into a tapered open end of the hollow post to thereby cause the insertion side to spread walls of the hollow post into a first expanded position includes inserting the anchor including at least one vertical ridge disposed on the downwardly extending sidewall such that the at least one vertical ridge prespreads the hollow deck post to the first expanded position by interacting with the taper at the end of the post to thereby allow the anchor to slip past said open end of said post.

Embodiment 52

The method of embodiment 50, wherein the at least one vertical ridge includes a set of parallel vertical ridges inserting the anchor prespreads the hollow deck post to the first expanded position by interacting with the taper at the end of the post to thereby allow the anchor to slip past said open end of said post.

Embodiment 53

The method of embodiment 49, wherein advancing the anchor further into the post until a widest portion of the anchor is received within the hollow post to thereby cause said widest portion of the anchor to spread the walls of the hollow post into a second expanded position such that said walls are further apart than they were when in the first expanded position includes advancing an anchor where the at least first laterally extending member is generally convex and causes a sidewall of the post to flex thereover as it is advanced.

What is claimed is:

1. An anchor for attaching a hollow post to a deck, comprising:

a body with a generally planar lower surface and an upwardly extending sidewall;

at least a first lateral ridge extending laterally from the upwardly extending sidewall, the at least first ridge shaped and configured to be retained in a groove formed on an interior sidewall of the hollow post;

at least one vertical ridge disposed on the upwardly extending sidewall, the at least one vertical ridge extending from the top of the at least first ridge to an upper end of the body; and a plurality of holes, each passing from the lower surface of the body through a bottom of the body and sized to receive a lag screw or nut and bolt for attachment to a deck.

2. The anchor of claim 1, wherein the body has a generally polygonal shape.

3. The anchor of claim 1, wherein the body comprises a set of opposing longer sides, wherein each of the opposing longer sides corresponds to major sides of the hollow post, including the upwardly extending sidewall, and a set of shorter sides disposed between the opposing longer sides that correspond to corners of the hollow post.

4. The anchor of claim 1, wherein the at least first ridge is generally convex, with a furthest lateral extension corresponding to a midpoint at least one of the opposing longer sides.

5. The anchor of claim 1, wherein the at least one vertical ridge has a generally columnar cross section.

6. The anchor of claim 1, wherein the at least one vertical ridge comprises a set of parallel vertical ridges spaced along the upwardly extending sidewall along the at least first ridge.

7. The anchor of claim 1, further comprising at least a second vertical ridge, the at least second vertical ridge extending from the top of the at least second ridge to an upper end of the body.

8. The anchor of claim 7, wherein the at least a second vertical ridge comprises a set of parallel vertical ridges.

9. The anchor of claim 7, wherein the at least second vertical ridge tapers from a thicker lower portion to thinner upper end.

10. The anchor of claim 1, further comprising at least one vertical ridge disposed on the upwardly extending sidewall, the at least one vertical ridge extending from the top of the at least first ridge to an upper end of the body.

11. The anchor of claim 10, wherein the at least one vertical ridge comprises a set of parallel vertical ridges spaced along the upwardly extending sidewall along the at least first ridge.

12. The anchor of claim 1, wherein the plurality of holes comprises four holes spaced around a midpoint of the body.

13. An anchor for attaching a hollow post to a deck, comprising:

a body with a generally planar lower surface and an upwardly extending sidewall;

at least a first ridge extending laterally from the upwardly extending sidewall, the at least first ridge shaped and configured to be retained in a groove formed on an interior sidewall of the hollow post; and at least a first vertical ridge and an opposite second vertical ridge disposed on the upwardly extending sidewall on at least two opposing sides of a mount, each of the at least first vertical ridge and second vertical ridge extending from the top of the at least first ridge to an upper end of the body.

14. The anchor of claim 13, wherein the body has a generally polygonal shape.

15. The anchor of claim 14, wherein the body has a set of opposing longer sides corresponding to major sides of the hollow post and a set of shorter sides disposed between the opposing longer sides that correspond to corners of the hollow post.

16. The anchor of claim 13, wherein the at least first ridge is generally convex, with a furthest lateral extension corresponding to a midpoint of an opposing longer side.

17. The anchor of claim 13, wherein the at least first vertical ridge has a generally columnar cross section.

18. The anchor of claim 13, wherein the at least first vertical ridge tapers from a thicker lower portion to thinner upper end.

19. The anchor of claim 13, wherein the at least first vertical ridge comprises a set of parallel vertical ridges spaced along the upwardly extending sidewall along the at least first ridge.

20. The anchor of claim 19, wherein the opposite second vertical ridge comprises a set of parallel vertical ridges spaced along the upwardly extending sidewall along the at least second ridge.

21. The anchor of claim 20, wherein the plurality of holes comprises four holes spaced around a midpoint of the body.

22. The anchor of claim 13, further comprising a plurality of holes, with each of the plurality of holes passing from the lower surface of the body through a bottom of the body and being sized to receive a lag screw, or nut and bolt for attachment to a deck.

23. A deck post anchoring system, comprising:

a hollow deck post having an internal bore wherein at least a first lateral channel is disposed on a sidewall of an internal bore and a taper being formed at the end of the post;

a body with a generally planar upper surface and a downwardly extending sidewall, with at least a first ridge extending laterally from the downwardly extending sidewall, the at least a first ridge shaped and configured to be retained in the first lateral channel, an anchor, wherein the anchor comprises at least one vertical ridge disposed on the downwardly extending sidewall, the at least one vertical ridge extending from the top of the at least first ridge to an upper end of the body, the anchor including:

a plurality of holes, each passing from the upper surface of the body through a bottom of the body and sized to receive a lag screw for attachment to a deck; and a plurality lag screws sized for placement in the plurality of holes.

24. The system of claim 23, wherein the hollow deck post and the anchor have corresponding generally polygonal shapes.

25. The system of claim 24, wherein the anchor body has a set of opposing longer sides corresponding to major sides of the hollow deck post and a set of shorter sides disposed between the opposing longer sides that correspond to corners of the hollow deck post.

26. The system of claim 25, wherein the at least first ridge is generally convex, with a furthest lateral extension from the downwardly extending sidewall corresponding to a midpoint of at least one of the opposing longer sides.

27. The system of claim 23, further comprising least a second lateral channel disposed on a sidewall of the internal bore of the hollow deck post and at least a second ridge extending laterally from the downwardly extending sidewall at a point on the anchor body opposite the at least a first ridge, the at least second ridge shaped and configured to be retained in the at least second lateral channel.

28. The system of claim 23, wherein the anchor further comprises at least one vertical ridge disposed on the downwardly extending sidewall, the at least one vertical ridge extending from the top of the at least first ridge to an upper end of the body.

29. The system of claim 23, wherein the at least one vertical ridge has a generally columnar cross section.

30. The system of claim 23, wherein the at least one vertical ridge tapers from a thicker lower portion to thinner upper end.

31. The system of claim 23, wherein the at least one vertical ridge comprises a set of parallel vertical ridges spaced along the downwardly upwardly extending sidewall along the at least first ridge.

32. The system of claim 31, wherein the set of parallel vertical ridges arranged to prespread the hollow deck post by interacting with the taper at the end of the post to thereby allow the anchor to slip past said open end of said post, to inhibit the anchor from bottoming out on said open end of said post during insertion.

33. The system of claim 23, wherein the plurality of holes comprises eight holes spaced around a midpoint of the body.

34. The system of claim 33, wherein the plurality of lag screws comprises four lag screws.

* * * * *